United States Patent [19]

Arnesen

[11] 4,146,996

[45] Apr. 3, 1979

[54] THERMO-VACUUM STRUCTURE

[76] Inventor: Tore O. Arnesen, 514 S. 52nd St., Omaha, Nebr. 68106

[21] Appl. No.: 843,269

[22] Filed: Oct. 18, 1977

[51] Int. Cl.[2] ..... E04B 1/345

[52] U.S. Cl. ..... 52/2; 52/404

[58] Field of Search ..... 52/2, 404

[56] References Cited

U.S. PATENT DOCUMENTS 3,258,883 7/1966 Campanaro et al. ..... 52/404

*Primary Examiner*—J. Karl Bell

[57] ABSTRACT

The invention relates to the field of building construction. It is a structure composed of a rigid space form and a partial vacuum enclosed by a double layer of fabric. The enclosed partial vacuum not only acts as a thermal barrier, but also causes a pressure differential between the outer and inner faces of the fabrics. This pressure differential supports the inner fabric layer, and stresses the outer fabric layer in such a manner as to cause it to cling to the rigid space form.

2 Claims, 4 Drawing Figures

THERMO-VACUUM STRUCTURE

SUMMARY

This invention utilizes some of the component parts of conventional air-structures. The air-structures to which I refer are of two distinct types: the inflated type and/or supported type.

The inflated type is a single or double layered fabric structure which is supported by an air pressure differential. The enclosed space must have a pressure greater than atmospheric pressure.

The supported type is usually held in place by a rigid lattice type structure. The fabric sometimes is stressed in tension to make it cling to the structure.

Air-structures and the thermo-vacuum structure are both lightweight, water proof structural systems. But the thermo-vacuum structure is more energy efficient because it has lower heating and cooling loads. The more energy efficient air-structures usually lower heat transmission by trapping pockets of pressurized air between two fabric layers. The thermo-vacuum structure has an enclosed partial vacuum which provides a more effective thermal barrier.

DETAILED DESCRIPTION

Figure 1:
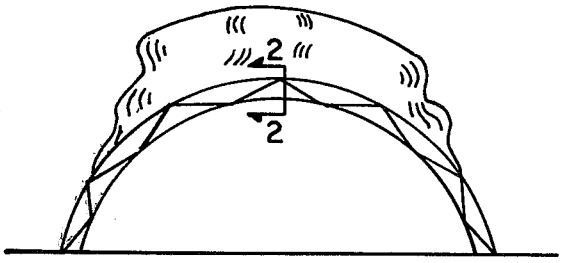
FIG. 1 is an elevation through a trussed barrel vault incorporating the features of the thermo-vacuum structure.

The essential component parts of the thermo-vacuum structure are the numbered elements shown in the brief description and a vacuum pump.

The essential components shown are:

1 — The outer fabric
2 — The inner fabric
3 — The rigid space form
4 — The interstitial space
5 — The fabric walls
6 — The pressure differential
7 — The fabric hangers The outer fabric 1 of the thermo-vacuum structure as in the air-structure must be able to withstand the assault of ultra violet radiation and minimize the loss of air pressure differential 6. Any damage to the outer fabric 1 will not affect the stability of the structure since support is provided by the rigid space form 3. Because of the higher pressure on the exterior surface of the outer fabric 1, the outer fabric 1 will cling to the space form 3.

Figure 2:
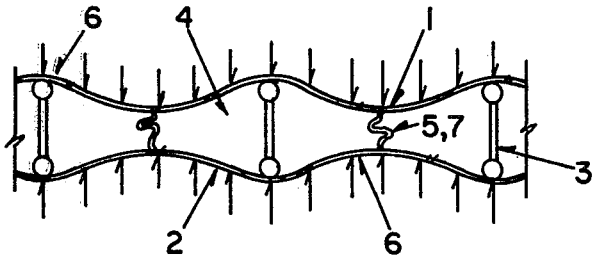
FIG. 2 is a cross-sectional view as indicated in FIG. 1 by the line 2—2. This section illustrates the system in its active state, with its vacuum pump operational.
Figure 3:
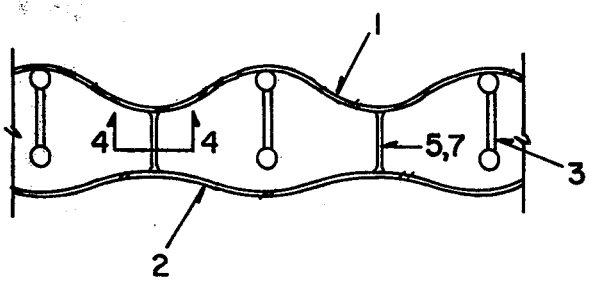
FIG. 3 represents the same cross-sectional view as FIG. 2, but in this case no partial vacuum is induced and the system is in its passive state. The essential component parts would be the same as FIG. 2 minus the enclosed partial vacuum and the pressure differential.
Figure 4:
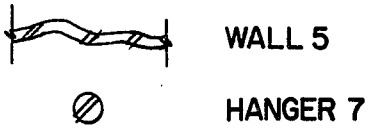
FIG. 4 is a cross-sectional view as indicated in FIG. 3 by the line 4—4. This section illustrates the two alternate and interchangeable methods of supporting the inner fabric when the system is in its passive state.

The thermo-vacuum structure can be serviced by one or more vacuum pumps. Parts of the structure can be separated one from another by a fabric wall 5. This wall will make it possible to have each separate unit serviced by an independent vacuum pump. If one pump fails or is shut down it will not affect the partial vacuums in adjacent units. The fabric walls 5 also act as supports for the inner fabric 2 when the partial vacuum is lost. If one does not want to subdivide the structure into independent units one can eliminate the fabric walls 5 and just provide fabric hangers 7 as shown in FIGS. 2 and 3.

The rigid space form 3 need not be limited to any particular configuration or type. The brief description shows trussed arches forming a barrel vault. It could just as well have been a space frame taking the configuration of a dome. The rigid space form 3 must be able to support the loads imposed upon it by the natural environment, the component parts of the structure, as well as the loads imposed upon it by the partial vacuum. It must also provide the necessary separation between the outer 1 and inner 3 fabric layers.

The vacuum shall be provided by vacuum pumps which will have to be sized according to the requirements imposed upon it. The more perfect the vacuum attained the more efficient the structure is as a thermal barrier, but also the larger the load imposed upon the pump. The minimum load imposed on the pump is that needed to provide the pressure differential 6 to support the inner skin 2, and to replace pressure losses through the fabric material and its seams.

Inflatable air structures require a pump to pressurize the interior space enclosed by the structure. The pump has to overcome pressure loss through the material and its seams, as well as infiltration through openings such as doors, windows, and vents. Air-structures also require such things as special doors to minimized the loss of pressure. The thermo-vacuum structure only has to overcome the loss of pressure through the fabric material and seams, since the pressure in the interior space is at atmospheric pressure.

By regulating the amount of partial vacuum induced one can minimize energy usage. If the interior space is maintained at 70° and the temperature of the natural environment is 70° there will be no need to insulate the interior space. One can therefore have the vacuum pump shut down. If the temperature difference between the exterior and interior space of the structure is large one can increase the partial vacuum accordingly. An inflatable air-structure does not have this advantage.

All materials and equipment needed for the proper function of the thermo-structure are commercially available. The technological advances that made air-structures a feasible structural system also make the thermo-vacuum structure feasible. Life cycle costing make the thermo-vacuum structure a more viable alternative. The initial cost of the thermo-structure structure may be higher than most air-structures, because it needs two fabric layers and a rigid space form, but still is lower initially than most other structural alternatives. It is becoming more evident that initial material costs are a small part of the cost of the structure according to life cycling. When one considers the smaller heat losses over the life of the structure, the advantages of the thermo-structure become evident. The faster fuel costs increase, the more advantageous a structural alternative the thermo-vacuum structure becomes.

Any mechanical equipment such as ducts or piping that run through the interstitial space 4 will have the advantage of being insulated by the partial vacuum.

I claim:

1. The Thermo-vacuum structure provides a relatively energy-efficient shelter from the natural environment and is comprised of: an outer and inner fabric skin which is separated by an interstitial space; and a load bearing rigid space form contained between the above mentioned skins; and fabric hangers connecting the outer and inner fabric skin; and a partial vacuum induced by one or more vacuum pumps and contained within the interstitial space.

2. The Thermp-vacuum structure provides a relatively energy-efficient shelter from the natural environment and is comprised of: an outer and inner fabric skin which is separated by an interstitial space; an a load bearing rigid space form contained between the above mentioned skins; and fabric walls, connecting the outer and inner fabric skins, which divides the above mentioned interstitial space into a series of independent cells; and partial vacuums induced by one or more vacuum pumps and contained within the intersitial space.

* * * * *

UNITED STATES PATENT AND TRADEMARK OFFICE

CERTIFICATE OF CORRECTION

PATENT NO. : 4,146,996

DATED : April 3, 1979

INVENTOR(S) : Tore O. Arnesen

It is certified that error appears in the above-identified patent and that said Letters Patent are hereby corrected as shown below:

Column 3, line 7, "The Thermp-vacuum" should read

-- The Thermo-vacuum --.

Signed and Sealed this

*Seventh* Day of *August 1979*

[SEAL]

*Attest:*

*Attesting Officer*

LUTRELLE F. PARKER

*Acting Commissioner of Patents and Trademarks*